US012410681B2

(12) United States Patent
Dave et al.

(10) Patent No.: US 12,410,681 B2
(45) Date of Patent: Sep. 9, 2025

(54) TUBING AND CONTROL LINE HYDROSTATIC-INSENSITIVE SINGLE CONTROL LINE SAFETY VALVE

(71) Applicant: Halliburton Energy Services, Inc., Houston, TX (US)

(72) Inventors: Jalpan Piyush Dave, Singapore (SG); Mohan Gunasekaran, Singapore (SG); Michael Linley Fripp, Singapore (SG); Cheng Xiang Adrian Khor, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 18/537,795

(22) Filed: Dec. 12, 2023

(65) Prior Publication Data

US 2025/0188817 A1 Jun. 12, 2025

(51) Int. Cl.
*E21B 34/10* (2006.01)

(52) U.S. Cl.
CPC ..... *E21B 34/102* (2013.01); *E21B 2200/05* (2020.05); *E21B 2200/06* (2020.05)

(58) Field of Classification Search
CPC ..... E21B 23/042; E21B 34/10; E21B 34/102; E21B 34/14
See application file for complete search history.

(56) References Cited

U.S. PATENT DOCUMENTS 4,621,695 A * 11/1986 Pringle ..... E21B 34/10 251/63.4
5,564,501 A * 10/1996 Strattan ..... E21B 34/10 166/324
5,906,220 A * 5/1999 Thompson ..... E21B 34/10 166/324
7,264,059 B2 * 9/2007 Akselberg ..... E21B 34/10 166/381
7,503,385 B2 * 3/2009 Tips ..... E21B 23/042 166/319
7,552,774 B2 * 6/2009 Anderson ..... E21B 34/101 166/321
7,694,742 B2 * 4/2010 Bane ..... E21B 23/065 166/374
7,743,833 B2 * 6/2010 Cascario ..... E21B 34/101 166/332.8

(Continued)

FOREIGN PATENT DOCUMENTS

EP 2094939 B1 * 9/2011 ..... E21B 34/101

OTHER PUBLICATIONS

International Search Report and Written Opinion dated Sep. 10, 2024 for PCT/US2023/085949.

(Continued)

*Primary Examiner* — Jennifer H Gay
(74) *Attorney, Agent, or Firm* — The Hilton Firm PLLC

(57) ABSTRACT

Safety valves and methods of using safety valves. The safety valve is provided to a wellbore having a hydrostatic pressure. The safety valve is configured to operate at tubing well pressure. Pressure is applied to the safety valve with a single control line. The safety valve uses an accumulator in fluidic communication with the control line such that pressure acting on the accumulator is fluidically connected to pressure in the control line. The safety valve is insensitive to the hydrostatic pressure.

20 Claims, 5 Drawing Sheets

(56) References Cited

U.S. PATENT DOCUMENTS

| | | | | |
|---|---|---|---|---|
| 9,732,588 | B2 | 8/2017 | Fripp et al. | |
| 10,458,202 | B2 * | 10/2019 | Dave | F15B 13/044 |
| 10,619,451 | B2 | 4/2020 | Jones | |
| 10,794,148 | B2 * | 10/2020 | Williamson | E21B 34/102 |
| 10,954,733 | B2 * | 3/2021 | Chiam | F15B 11/10 |
| 10,989,020 | B2 * | 4/2021 | Vick, Jr. | E21B 34/16 |
| 2004/0149448 | A1 * | 8/2004 | Akselberg | E21B 34/10 166/373 |
| 2006/0254763 | A1 * | 11/2006 | Tips | E21B 34/16 166/65.1 |
| 2008/0066921 | A1 * | 3/2008 | Bane | E21B 34/10 166/332.8 |
| 2008/0128137 | A1 * | 6/2008 | Anderson | E21B 34/101 166/321 |
| 2009/0188662 | A1 * | 7/2009 | Casciaro | E21B 34/10 166/53 |
| 2016/0053574 | A1 | 2/2016 | Miller et al. | |
| 2016/0273321 | A1 | 9/2016 | Frosell et al. | |
| 2018/0305999 | A1 * | 10/2018 | Dave | E21B 47/12 |
| 2018/0334883 | A1 * | 11/2018 | Williamson | E21B 34/102 |
| 2020/0308932 | A1 * | 10/2020 | Vick, Jr. | E21B 34/14 |
| 2020/0318448 | A1 * | 10/2020 | Chiam | E21B 47/12 |
| 2024/0301768 | A1 * | 9/2024 | Quilico | E21B 34/08 |

OTHER PUBLICATIONS

Search Report mailed Apr. 23, 2025 in Dutch Patent Application No. 2038788.

* cited by examiner

TUBING AND CONTROL LINE HYDROSTATIC-INSENSITIVE SINGLE CONTROL LINE SAFETY VALVE

TECHNICAL FIELD

The present disclosure relates generally to wellbore operations, and more particularly, to the installation and use of a single control line safety valve that is insensitive to hydrostatic pressure and tubing pressure without the need to workover the well or add a second control line for operation of the safety valve.

BACKGROUND

For some wellbore operations, it may be desirable to install or replace a safety valve. For example, some safety valves may be wireline retrievable safety valves which may be installed in the wellbore via a wireline. The installation and/or use of safety valves in wellbores with high hydrostatic pressure may present additional obstacles dues to the force of the hydrostatic pressure acting on the valve components. For wellbores with high hydrostatic pressure, a balance line may be used to counteract the hydrostatic pressure acting on the valve components. However, the use of a balance line requires the addition of another control line for the safety valve. The addition of a second control line may be prohibitively expensive for some wellbore operations.

Safety valves are an important part of wellbore operations. The present invention provides improved apparatus and methods for the installation and use of a single control line safety valve.

BRIEF DESCRIPTION OF THE DRAWINGS

Illustrative examples of the present disclosure are described in detail below with reference to the attached drawing figures, which are incorporated by reference herein, and wherein.

Figure 1:
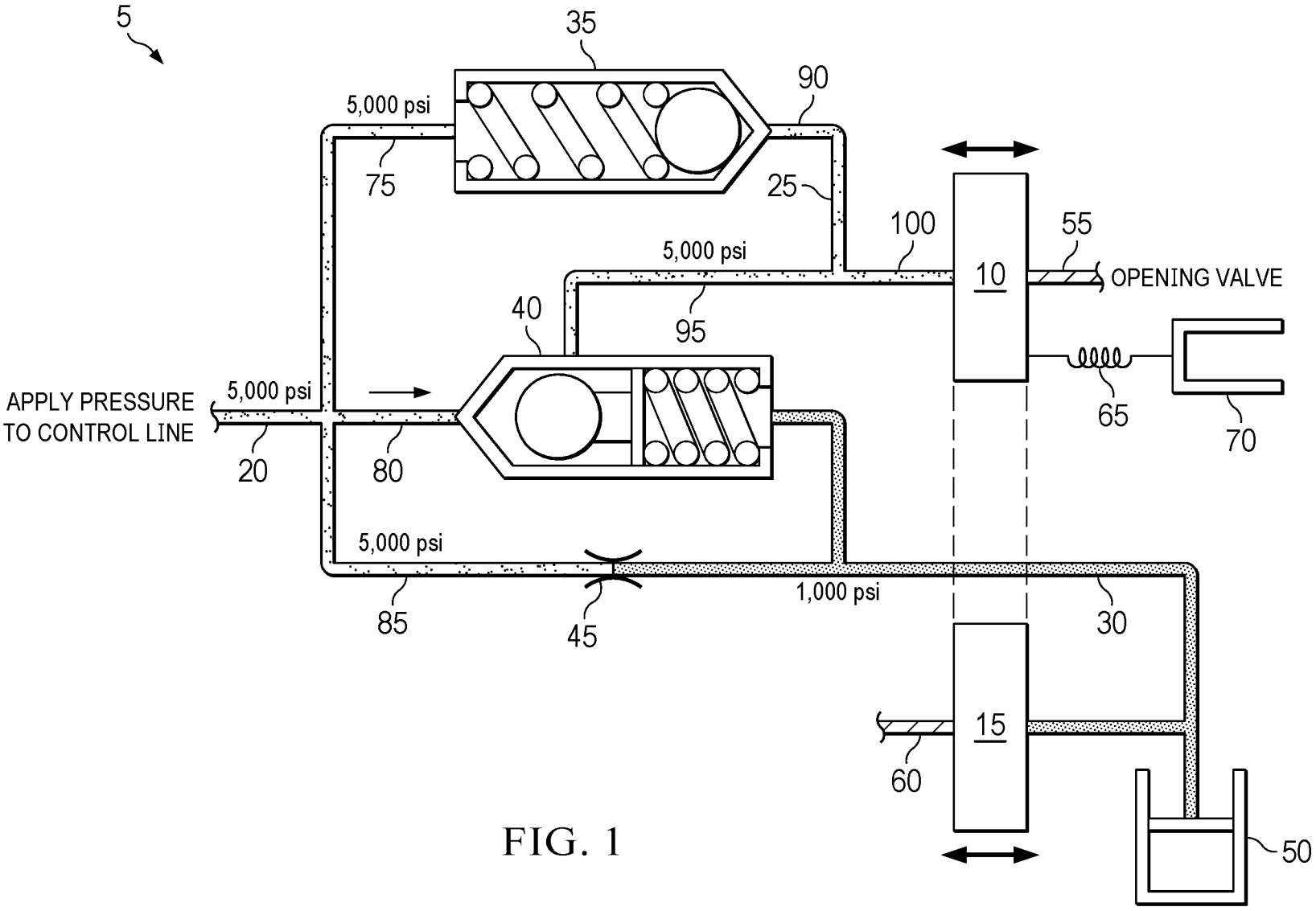
FIG. 1 is a schematic illustrating the use of an example safety valve in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the installation and use of a single control line safety valve that is insensitive to hydrostatic pressure and tubing pressure without the need to workover the well or add a second control line for operation of the safety valve.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms upstream and downstream may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the installation and use of a single control line safety valve in wells having high hydrostatic pressure without the need to workover the well or add a second control line for operation of the safety valve. Advantageously, the safety valve may be installed in a wellbore using a wireline, tubing, or other such method for positioning the safety valve in the wellbore at a desired location. As an additional advantage the safety valve may be retrieved with the wireline, tubing, or other such retrieval method. A further advantage is that the safety valve uses a balance piston thereby making the safety valve more robust to extreme wellbore environments such as those having high hydrostatic pressures. This functionality allows the safety valve to be insensitive to hydrostatic pressure from either the tubing or the control line as well as to tubing pressure. The safety valve is only sensitive to the applied pressure from the control line. Moreover, the safety valve uses but a single control line descending from the surface for operation thereby preventing the need to workover the well or install another control line. In some wells, the safety valve may be installed to function with an already existing control line. Installation of a second control line may prohibitively increase operational expenditures. Thus, the installation of a safety valve that can be used with an already existing control line and can be installed without workover or additional operations may greatly reduce overall remediation expenses for wellbore issues such as leaking gas chambers. Moreover, the safety valve may be useable in high hydrostatic pressure environments and is also tubing pressure insensitive. As such, the safety valve may be operated with the single control line even when wellbore hydrostatic pressure is high and/or control line pressure is high. Another advantage is that the safety valve does not use gas charged valves and as such, there is no possibility of the gas charges leaking and failing over time. Additionally, the safety valve utilizes a failsafe and should control line pressure be lost or purposefully cut, the safety valve failsafe will push the valve closed thereby preventing uncontrolled flow across the valve.

FIG. 1 is a schematic of an example safety valve, generally 5, comprising an operating piston 10, a balance piston 15, a control line 20, a pressure lock flow path 25, a balance pressure line 30, a check valve 35, a poppet valve 40, a flow restrictor 45, and an accumulator 50. The opening piston 10 and the balance piston 15 are mechanically or hydraulically linked as illustrated. The operating piston 10 and the balance piston 15 are configured to translate axially along the length of the safety valve 5 as illustrated by the adjacent arrow. Tubing well pressure is applied to the operating piston 10 and the balance piston 15 from well line 55 and 60 respectively. In the illustrated example, the operating piston 10 is coupled to a spring 65 which is further coupled to a sliding sleeve 70. Sliding sleeve 70 is used to open a downhole flapper (not illustrated) for opening or closing of the safety valve 5 and allowing fluid flow through the safety valve 5. This opening of the flapper is accomplished by translating the operating piston 10, and consequently the balance piston 15, to the right in the illustrated figure. This translation of the operating piston 10 will compress the spring 65 which will then slide the sliding sleeve 70 to force open the flapper.

Translation of the operating piston 10 and linked balance piston 15 occurs at the same time. If the operating piston 10 and the linked balance piston 15 are mechanically linked they may also move in the same direction. Alternatively, a hydraulic coupling may be used to link the balance piston and the operating piston with a hydraulic line that moves them in different directions. In order to translate operating piston 10, hydraulic pressure is applied via the pressure flow path 25. The pressure lock flow path 25 may be a separate conduit component such as a line or may be a flow path present within a component. The hydraulic pressure within the pressure lock flow path 25 is supplied by the control line 20. Control line 20 descends from the surface uphole of the safety valve 5. Control line 20 descends from the surface as a single control line 20 with a supply of hydraulic fluid which may be used to operate coupled downhole equipment such as safety valve 5. Downhole, the control line 20 splits into three flow paths for operation of the safety valve 5. A flow path of the control line may be a separate conduit component such as a line or may be a flow path present within a component. The first flow path 75 of the control line 20 couples to the check valve 35. The second flow path 80 of the control line 20 couples to the poppet valve 40. The third flow path 85 of the control line 20 couples to the flow restrictor 45. When in use, hydraulic fluid flows from the surface to all three flow paths of the control line 20. Check valve 35 is configured such that the default position closes the first flow path 75 of the control line 20. Check valve 35 may be any one-way valve that prevents backflow. Examples of check valve 35 may include, but are not limited to, ball-on-seat valves, reed valves, flapper valves, wafer valves, disc valves, swing valves, lift and piston valves, and the like. Flow across the check valve 35 from the first flow path 75 of the control line towards the pressure lock flow path 25 does not occur as flow is only allowed in the reverse direction. Poppet valve 40 is configured to crack at a lower pressure threshold than the check valve 35. Poppet valve 40 may be any type of valve having a suitable cracking pressure for the application. As the hydraulic pressure in the second flow path 80 of the control line 20 exceeds the cracking threshold of the poppet valve 40, the poppet valve 40 will crack and allow hydraulic fluid to flow past poppet valve 40 to the pressure lock flow path 25. The poppet valve 40 is configured to not allow flow in the direction of the balance pressure line 30 from the control line 20. Flow is only allowed from the control line 20 into the pressure lock flow path 25 when the cracking pressure of the poppet valve 40 is exceeded. The pressure lock flow path 25 comprises three segments. The first segment 90 of the pressure lock flow path 25 is coupled to the check valve 35. The second segment 95 of the pressure lock flow path 25 is coupled to the poppet valve 40. The third segment 100 of the pressure lock flow path 25 is coupled to the operating piston 10. To translate the operating piston 10, the hydraulic pressure applied to the poppet valve 40 should exceed the threshold necessary to crack the poppet valve 40. The applied hydraulic pressure should then exceed a threshold sufficient to translate the operating piston 10 after entering the pressure lock flow path 25.

As the poppet valve 40 cracks, the hydraulic pressure on both sides of the check valve 35 is equalized and the additional force applied by the spring of the check valve 35 maintains the check valve 35 in the default closed position. At the third flow path 85 of the control line 20, the hydraulic fluid flows across the flow restrictor 45 slowly thereby keeping the hydraulic pressure in the balance pressure line 30 less than the hydraulic pressure in the control line 20 and the pressure lock flow path 25. The flow restrictor 45 may have the same or different restrictions in different directions (e.g., a vortex restrictor). In some examples, the flow restrictor may have a cracking pressure. The building pressure within the pressure lock flow path 25 results in the translation of the operating piston 10, and consequently the linked balance piston 15. The operating piston 20 is translated to the right to compress spring 65, slide sleeve 70, and open the downhole flapper. The safety valve 5 is then opened for flow therethrough.

Figure 2:
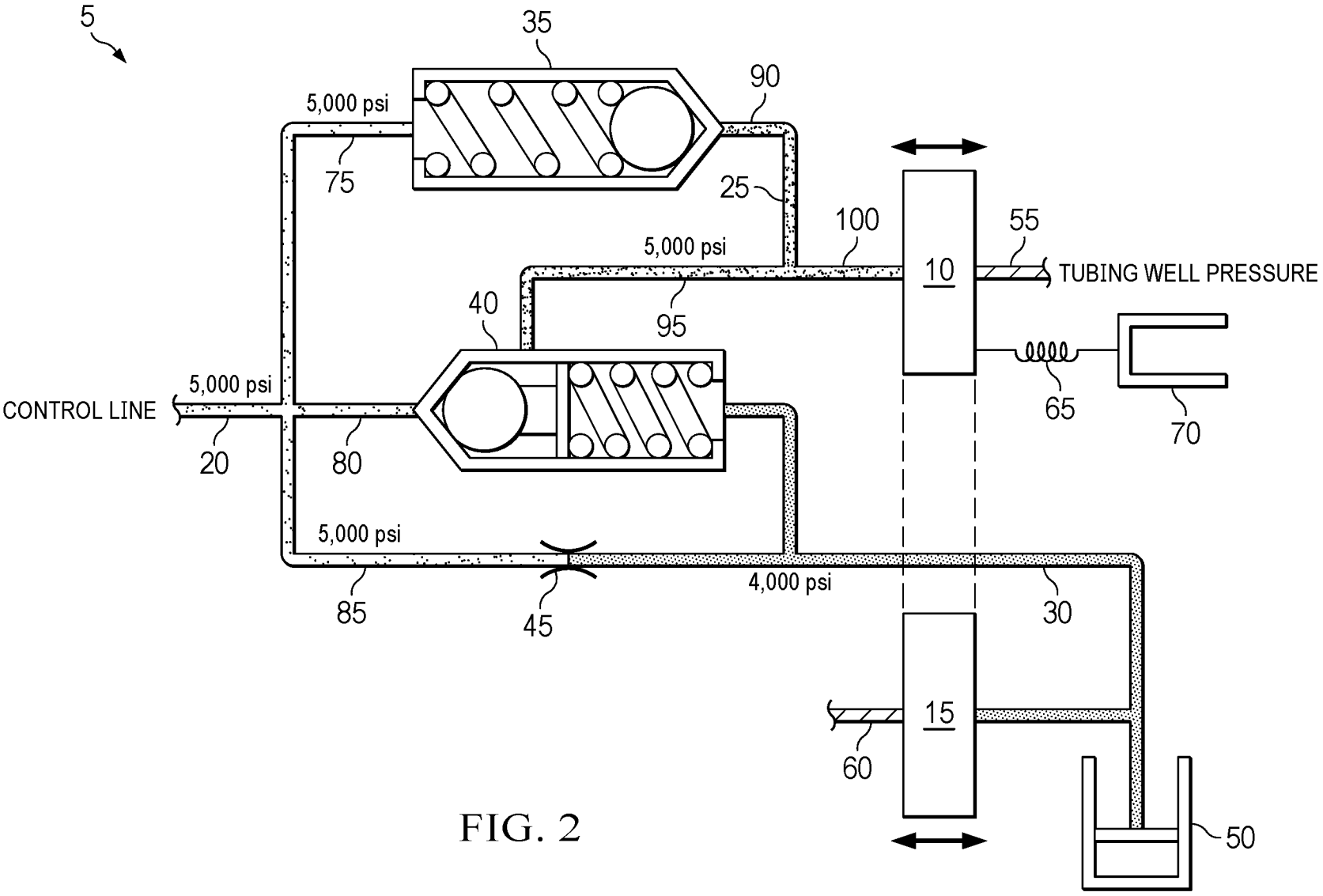
FIG. 2 is a schematic continuing the illustration of the use of the example safety valve of FIG. 1 in accordance with one or more examples described herein.

Referring now to FIG. 2, the schematic of FIG. 1 is illustrated with the poppet valve 40 closed. If the poppet valve 40 closes while the check valve 35 is also closed, the hydraulic pressure in the pressure lock flow path 25 is locked in. The spring-loaded poppet valve 40 and the spring-loaded check valve 35 are biased such that they default to the closed position to shut off hydraulic flow from the control line 20 to the pressure lock flow path 25. Should pressure drop below the cracking pressure of the poppet valve 40 or the pressure in the balance pressure line 30 equalizes with the control line 20, the poppet valve 40 will close and lock in the hydraulic pressure in the pressure lock flow path 25. If the hydraulic pressure is locked whole the flapper is open, then valve 5 will be held open by keeping the hydraulic pressure applied to the operating piston 20. Further, the accumulator 50 has begun to store hydraulic pressure in the balance pressure line 30 as the hydraulic pressure within the balance pressure line 30 has been steadily, but slowly increasing due to the restriction in hydraulic fluid flow through the flow restrictor 45.

Figure 3:
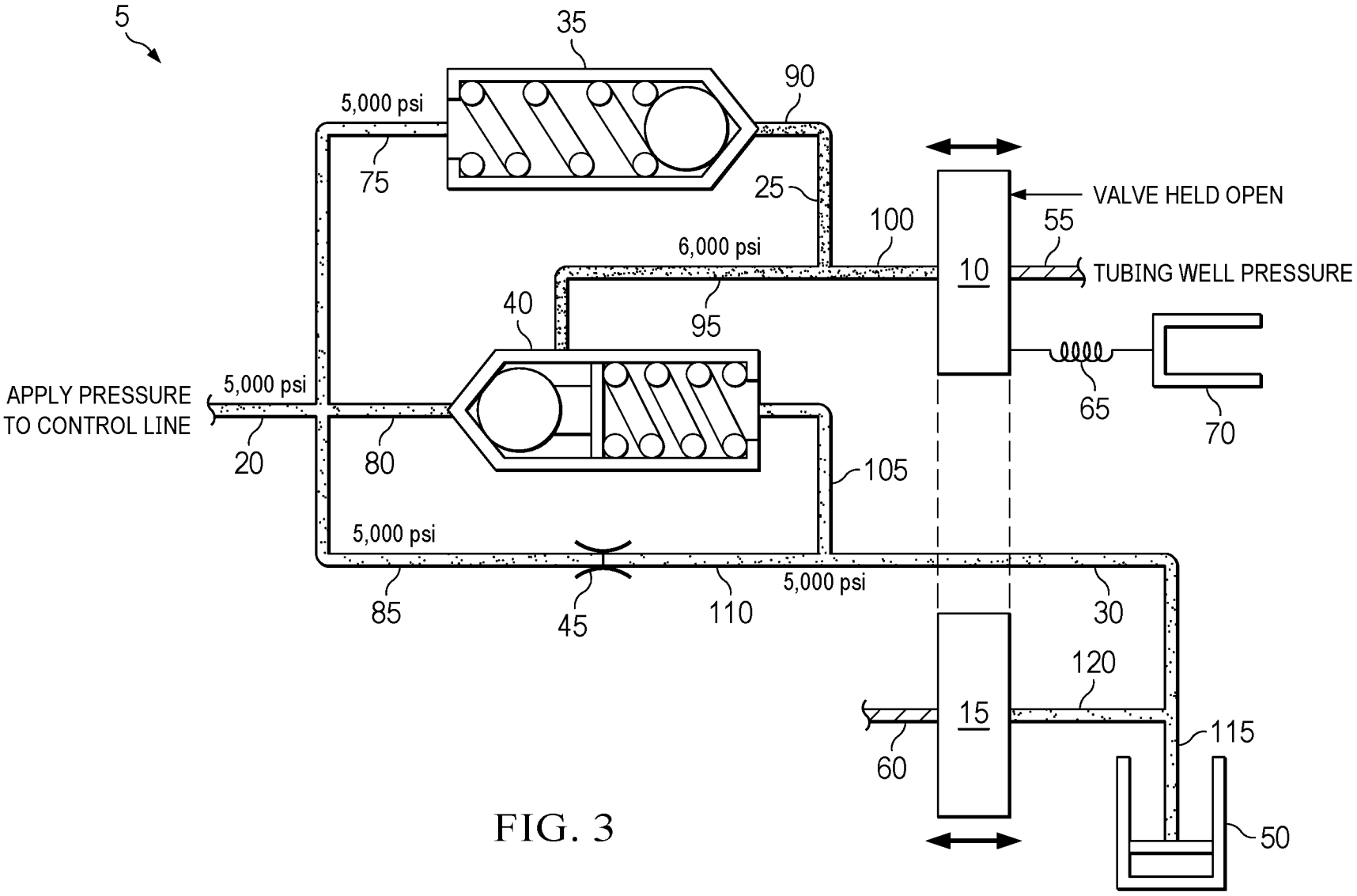
FIG. 3 is a schematic continuing the illustration of the use of the example safety valve of FIGS. 1 and 2 in accordance with one or more examples described herein.

FIG. 3 is a schematic illustrating the equalization of the hydraulic pressure in the control line 20 and the balance pressure line 30. Due to the effects of the flow restrictor 45, the flow of hydraulic fluid into the balance pressure line 30 is reduced relative to the flow of hydraulic fluid to the two other flow paths of the control line 20. The balance pressure line 30 comprises four segments. The first segment 105 of the balance pressure line 30 is the portion of the balance pressure line 30 that is coupled to the poppet valve 40. The second segment 110 of the balance pressure line 30 is the portion of the balance pressure line 30 that is coupled to the flow restrictor 45. The third segment 115 of the balance pressure line 30 is the portion of the balance pressure line 30 that is coupled to the accumulator 50. The fourth segment 120 of the balance pressure line 30 is the portion of the balance pressure line 30 that is coupled to the balance piston 15.

As the flow of hydraulic fluid proceeds through the flow restrictor 45, the pressure in the balance pressure line 30 begins to equalize with the pressure in the control line 20. The pressure within the pressure lock flow path 25 remains locked and the operating piston 10 holds the safety valve 5 in the open position because spring 65 remains compressed to keep the sliding sleeve 70 translated to the right to open the flapper of the safety valve 5. The accumulator 50 has also increased in stored hydraulic pressure as shown by the change in level within the illustration. The poppet valve 40 and the check valve 45 remain in the default closed position with their spring mechanisms extended. In some examples, the flow restrictor 45 may be configured to restrict flow in one direction more than the other. For example, the flow restrictor 45 may restrict hydraulic fluid flow from the third flow path 85 of the control line 20 to the second segment 110 of the balance control line 30 more than from the second segment 110 of the balance control line 30 to the third flow path 85 of the control line 20. Alternatively, the flow restrictor 45 may restrict hydraulic fluid flow from the second segment 110 of the balance control line 30 to the third flow path 85 of the control line 20 more than from the third flow path 85 of the control line 20 to the second segment 110 of the balance control line 30.

Figure 4:
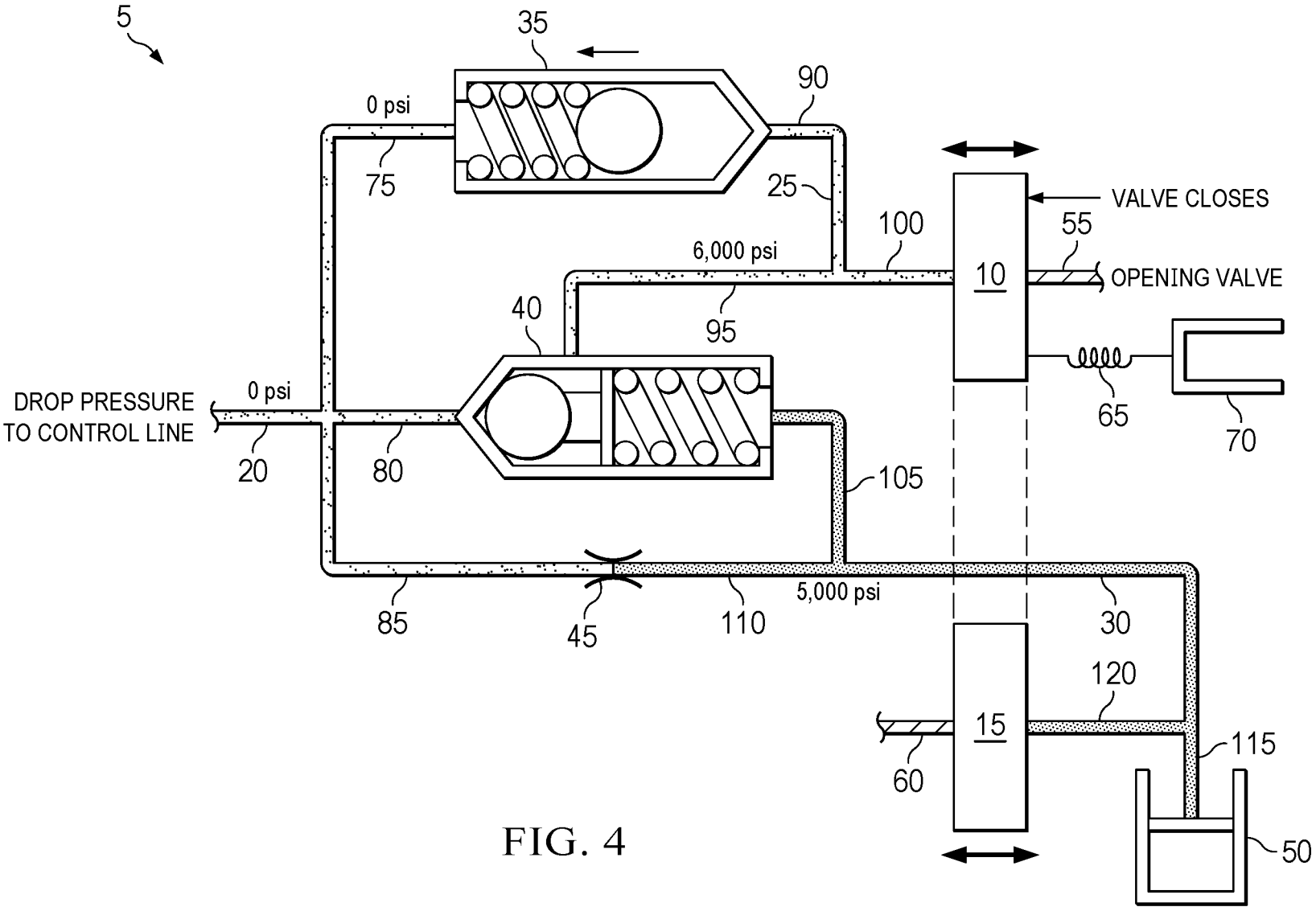
FIG. 4 is a schematic continuing the illustration of the use of the example safety valve of FIGS. 1-3 in accordance with one or more examples described herein.

FIG. 4 is a schematic illustrating a drop in hydraulic pressure in the control line 20. If the hydraulic pressure in the control line 20 is reduced, the resulting pressure differential may become large enough for the locked hydraulic pressure in the pressure lock flow path 25 to exceed the cracking pressure of the check valve 35. When the hydraulic pressure within the pressure lock flow path 25 cracks the check valve 35, the locked hydraulic fluid within pressure lock flow path 25 will flow back into the control line 20. Subsequently, the loss of pressure in the pressure lock flow path 25 results in the operating piston 10 translating to the left thereby inducing the closing of the safety valve 5. The loss of pressure within the control line 20 also results in the hydraulic pressure in the balance pressure line 30 being higher than the hydraulic pressure within the control line 20. This change in hydraulic pressure will result in the flow of hydraulic fluid from the balance pressure line 30 and the accumulator 50 to the control line 20 by flowing through the flow restrictor 45. The flow restrictor 45 will slow flow from the balance pressure line 30 to the control line 20. If the pressure in the control line 20 drops too slowly or too abruptly, the compressed spring 65 will provide enough force to translate the operating piston 10 to the left thereby closing the safety valve 5. This forced closure will occur after a sufficient pressure drop occurs in the pressure lock flow path 25 such that the potential of the compressed spring 65 can overcome the force of the pressurized hydraulic fluid remaining in the pressure lock flow path 25.

Figure 5:
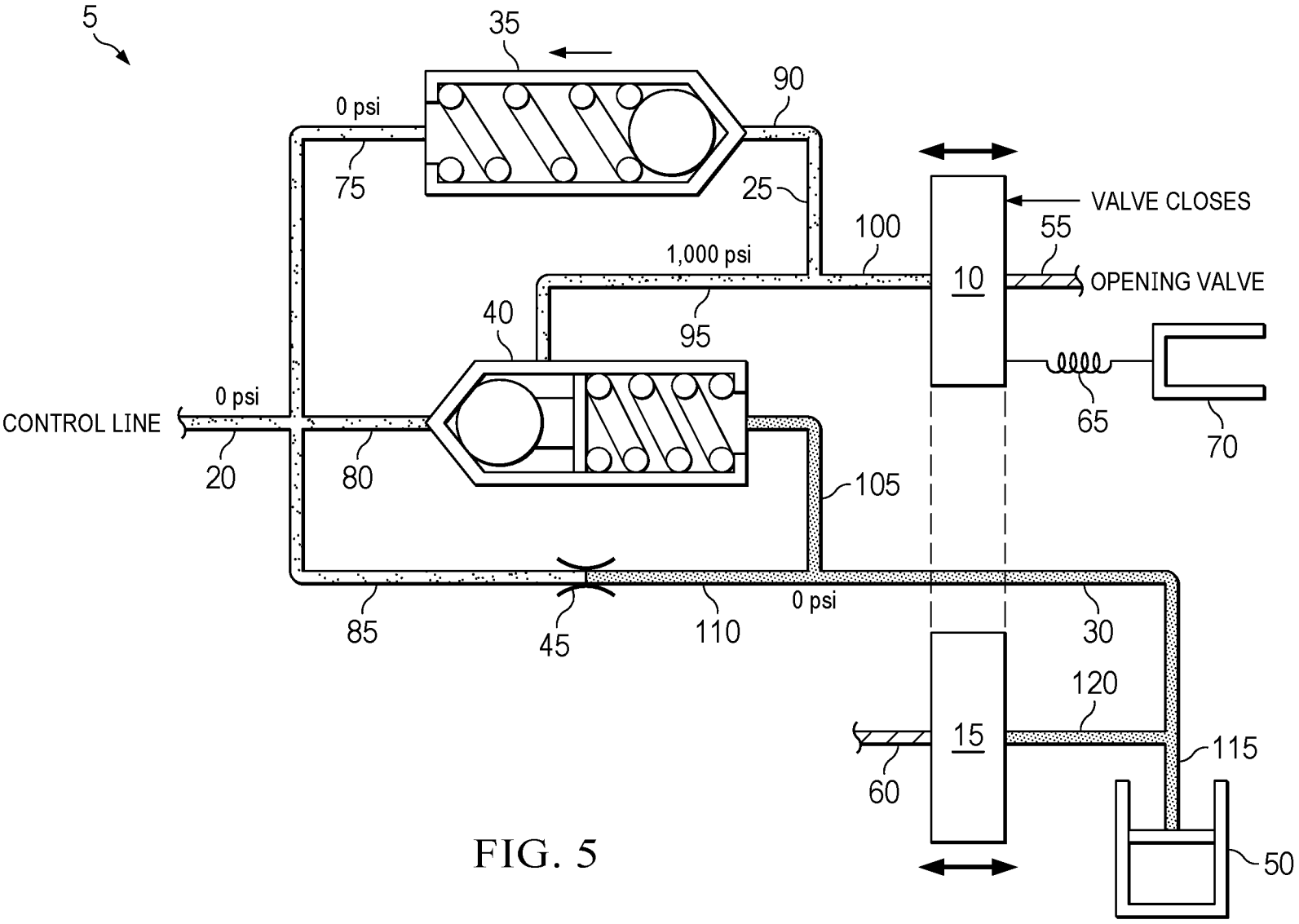
FIG. 5 is a schematic continuing the illustration of the use of the example safety valve of FIGS. 1-4 in accordance with one or more examples described herein.

FIG. 5 is a schematic illustrating the closure of the check valve 35 after a sufficient pressure drop in the pressure lock flow path 25 has occurred. When the flow of hydraulic fluid to the control line 20 is cut, the hydraulic pressure in the control line 20 continues to drop. Over time, the hydraulic pressure in the pressure lock flow path 25 will also continue to drop until it reaches a value lower than the cracking pressure of the check valve 35. At this point, the compressed spring mechanism of the check valve 35 will extend and close the check valve 35, resuming its default configuration. As the poppet valve 40 had closed previously, the pressure lock flow path 25 is now closed to the control line 20 and the balance pressure line 30. The operating piston 10 will remain translated to the left and the safety valve 5 will remain in the closed configuration. The balance pressure line 30 will also equalize with the control line 20 over time as these lines are not fluidically sealed from one another. The accumulator 50 will also reset to its default position.

It should be clearly understood that the example system illustrated by FIGS. 1-5 is merely a general application of the principles of this disclosure in practice, and a wide variety of other examples are possible. Therefore, the scope of this disclosure is not limited in any manner to the details of FIGS. 1-5 as described herein.

The systems disclosed herein may directly or indirectly affect one or more components or pieces of equipment associated with or which may come into contact with the systems such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided is a downhole device for a wellbore in accordance with the disclosure and the illustrated FIGs. An example downhole device comprises an operating piston configured to translate axially along the length of the safety valve; a balance piston configured to translate axially along the length of the safety valve; wherein the balance piston in coupled to the operating piston such that the operating piston and the balance piston translate axially at the same time; a control line; wherein the control line forms three flow paths; wherein the first flow path of the control line is coupled to a check valve; wherein the second flow path of the control line is coupled to a poppet valve; wherein the third flow path is coupled to a flow restrictor; a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston; a balance pressure line comprising four segments; wherein the first segment of the balance pressure line is coupled to the poppet valve; wherein the second segment of the balance pressure line is coupled to the flow restrictor; wherein the third segment of the balance pressure line is coupled to an accumulator; wherein the fourth segment of the balance pressure line is coupled to the balance piston; the check valve coupled to the first flow path of the control line and the first segment of the pressure lock flow path; the poppet valve coupled to the second flow path of the control line, the second segment of the pressure lock flow path, and the first segment of the balance pressure line; the flow restrictor coupled to the third flow path of the control line and the second segment of the balance pressure line; and the accumulator coupled to the third segment of the balance pressure line.

Additionally or alternatively, the downhole device may include one or more of the following features individually or in combination. The control line may be a single control line and there may not be other control lines coupled to the safety valve. The safety valve may be a wireline retrievable safety valve. The operating piston may be further coupled to a spring. The spring may be further coupled to a sliding sleeve configured to open or close a flapper upon the sliding of the sleeve. The poppet valve may be configured to crack at a lower pressure than the check valve. The poppet valve may be spring-loaded and may be configured to crack and open upon sufficient pressure applied from the second flow path of the control line; wherein the poppet spring applies force to the poppet such that the poppet blocks flow from the direction of the second flow path of the control line. The poppet valve may be configured to crack upon sufficient pressure to allow flow from the second flow path of the control line to the second segment of the pressure lock flow path. The poppet valve may be sealed to the first segment of the balance pressure line such that pressure is applied to the poppet valve from the balance pressure line without a flow of fluid across the poppet valve from the direction of the first segment of the balance pressure line. The check valve may be spring-loaded and is configured to crack and open upon sufficient pressure applied from the pressure lock flow path. The flow restrictor may be configured to restrict flow bidirectionally between the third flow path of the control line and the second segment of the balance pressure line; wherein the restriction in flow is greater in one direction than the other.

Provided are methods for operating a safety valve in accordance with the disclosure and the illustrated FIGs. An example method comprises providing the safety valve to a wellbore having a hydrostatic pressure; wherein the safety valve is configured to operate at tubing well pressure. The method further comprises applying pressure to the safety valve with a single control line; wherein the safety valve comprises an accumulator in fluidic communication with the control line such that pressure acting on the accumulator is fluidically connected to pressure in the control line; wherein the safety valve is insensitive to the hydrostatic pressure.

Additionally or alternatively, the method may include one or more of the following features individually or in combination. The safety valve may comprise an operating piston configured to translate axially along the length of the safety valve; a balance piston configured to translate axially along the length of the safety valve; wherein the balance piston is coupled to the operating piston such that the operating piston and the balance piston translate axially at the same time; a control line descending from an uphole surface; wherein the control line forms three flow paths; wherein the first flow path of the control line is coupled to a check valve; wherein the second flow path of the control is coupled to a poppet valve; wherein the third flow path is coupled to a flow restrictor; a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston; a balance pressure line comprising four segments; wherein the first segment of the balance pressure line is coupled to the poppet valve; wherein the second segment of the balance pressure line is coupled to the flow restrictor; wherein the third segment of the balance pressure line is coupled to the accumulator; wherein the fourth segment of the balance pressure line is coupled to the balance piston; the check valve coupled to the first flow path of the control line and the first segment of the pressure lock flow path; the poppet valve coupled to the second flow path of the control line, the second segment of the pressure lock flow path, and the first segment of the balance pressure line; and the flow restrictor coupled to the third flow path of the control line and the second segment of the balance pressure flow path. The method may further comprise applying pressure to the poppet valve from the second flow path of the control line to crack the poppet valve; building pressure in the pressure lock flow path to translate the operating piston upon cracking the poppet valve; wherein translation of the operating piston also translates the coupled balanced piston; and building pressure in the balance pressure line from the third flow path of the control line to close the poppet valve; wherein closing the poppet valve locks in the pressure in the pressure lock flow path to maintain the balance piston in its translated position. The method may further comprise reducing pressure to the control line; wherein reducing pressure to the control line releases a locked pressure in the safety valve. The may further comprise releasing pressure stored in the accumulator when the pressure in the control line is reduced. The control line may be a single control line and there may not be other control lines coupled to the safety valve. The safety valve may be a wireline retrievable safety valve. The operating piston may be further coupled to a spring. The spring may be further coupled to a sliding sleeve configured to open or close a flapper upon the sliding of the sleeve. The poppet valve may be configured to crack at a lower pressure than the check valve. The poppet valve may be spring-loaded and may be configured to crack and open upon sufficient pressure applied from the second flow path of the control line; wherein the poppet spring applies force to the poppet such that the poppet blocks flow from the direction of the second flow path of the control line. The poppet valve may be configured to crack upon sufficient pressure to allow flow from the second flow path of the control line to the second segment of the pressure lock flow path. The poppet valve may be sealed to the first segment of the balance pressure line such that pressure is applied to the poppet valve from the balance pressure line without a flow of fluid across the poppet valve from the direction of the first segment of the balance pressure line. The check valve may be spring-loaded and is configured to crack and open upon sufficient pressure applied from the pressure lock flow path. The flow restrictor may be configured to restrict flow bidirectionally between the third flow path of the control line and the second segment of the balance pressure line; wherein the restriction in flow is greater in one direction than the other.

Provided are systems for operating a safety valve in a wellbore in accordance with the disclosure and the illustrated FIGs. An example system comprises a safety valve comprising: an operating piston configured to translate axially along the length of the safety valve; a balance piston configured to translate axially along the length of the safety valve; wherein the balance piston in coupled to the operating piston such that the operating piston and the balance piston translate axially at the same direction and time; a control line descending from an uphole surface; wherein the control line forms three flow paths; wherein the first flow path of the control line is coupled to a check valve; wherein the second flow path of the control line is coupled to a poppet valve; wherein the third flow path is coupled to a flow restrictor; a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston; a balance pressure line comprising four segments; wherein the first segment of the balance pressure line is coupled to the poppet valve; wherein the second segment of the balance pressure line is coupled to the flow restrictor; wherein the third segment of the balance pressure line is coupled to an accumulator; wherein the fourth segment of the balance pressure line is coupled to the balance piston; the check valve coupled to the first flow path of the control line and the first segment of the pressure lock flow path; the poppet valve coupled to the second flow path of the control line, the second segment of the pressure lock flow path, and the first segment of the balance pressure line; the flow restrictor coupled to the third flow path of the control line and the second segment of the balance pressure line; and the accumulator coupled to the third segment of the balance pressure line. The system further comprises a spring coupled to the operating piston of the safety valve; and a sliding sleeve coupled to the spring.

Additionally or alternatively, the system may include one or more of the following features individually or in combination. The control line may be a single control line and there are no other control lines coupled to the safety valve. The safety valve may be a wireline retrievable safety valve. The flow restrictor may be configured to restrict flow bidirectionally between the third flow path of the control line and the second segment of the balance pressure line; wherein the restriction in flow is greater in one direction than the other. The sliding sleeve may be coupled to a flapper and the sliding sleeve is configured to open or close the flapper upon the sliding of the sleeve. The control line may be a single control line and there may not be other control lines coupled to the safety valve. The safety valve may be a wireline retrievable safety valve. The operating piston may be further coupled to a spring. The spring may be further coupled to a sliding sleeve configured to open or close a flapper upon the sliding of the sleeve. The poppet valve may be configured to crack at a lower pressure than the check valve. The poppet valve may be spring-loaded and may be configured to crack and open upon sufficient pressure applied from the second flow path of the control line; wherein the poppet spring applies force to the poppet such that the poppet blocks flow from the direction of the second flow path of the control line. The poppet valve may be configured to crack upon sufficient pressure to allow flow from the second flow path of the control line to the second segment of the pressure lock flow path. The poppet valve may be sealed to the first segment of the balance pressure line such that pressure is applied to the poppet valve from the balance pressure line without a flow of fluid across the poppet valve from the direction of the first segment of the balance pressure line. The check valve may be spring-loaded and is configured to crack and open upon sufficient pressure applied from the pressure lock flow path. The flow restrictor may be configured to restrict flow bidirectionally between the third flow path of the control line and the second segment of the balance pressure line; wherein the restriction in flow is greater in one direction than the other.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A safety valve for a wellbore comprising:

an operating piston configured to translate axially along the length of the safety valve;

a balance piston configured to translate axially along the length of the safety valve; wherein the balance piston in coupled to the operating piston such that the operating piston and the balance piston translate axially at the same time;

a control line; wherein the control line forms three flow paths; wherein the first flow path of the control line is coupled to a check valve; wherein the second flow path of the control line is coupled to a poppet valve; wherein the third flow path is coupled to a flow restrictor;

a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston;

a balance pressure line comprising four segments; wherein the first segment of the balance pressure line is coupled to the poppet valve; wherein the second segment of the balance pressure line is coupled to the flow restrictor; wherein the third segment of the balance pressure line is coupled to an accumulator; wherein the fourth segment of the balance pressure line is coupled to the balance piston;

the check valve;

the poppet valve;

the flow restrictor; and the accumulator.

2. The safety valve of claim 1, wherein the control line is a single control line and wherein there are no other control lines coupled to the safety valve.

3. The safety valve of claim 1, wherein the safety valve is a wireline retrievable safety valve.

4. The safety valve of claim 1, wherein the operating piston is further coupled to a spring.

5. The safety valve of claim 4, wherein the spring is further coupled to a sliding sleeve configured to open or close a flapper upon the sliding of the sleeve.

6. The safety valve of claim 1, wherein the poppet valve is configured to crack at a lower pressure than the check valve.

7. The safety valve of claim 1, wherein the poppet valve is spring-loaded and is configured to crack and open upon sufficient pressure applied from the second flow path of the control line; wherein the poppet spring applies force to the poppet such that the poppet blocks flow from the direction of the second flow path of the control line.

8. The safety valve of claim 1, wherein the poppet valve is configured to crack upon sufficient pressure to allow flow from the second flow path of the control line to the second segment of the pressure lock flow path.

9. The safety valve of claim 1, wherein the poppet valve is sealed to the first segment of the balance pressure line such that pressure is applied to the poppet valve from the balance pressure line without a flow of fluid across the poppet valve from the direction of the first segment of the balance pressure line.

10. The safety valve of claim 1, wherein the check valve is spring-loaded and is configured to crack and open upon sufficient pressure applied from the pressure lock flow path.

11. The safety valve of claim 1, wherein the flow restrictor is configured to restrict flow bidirectionally between the third flow path of the control line and the second segment of the balance pressure line; wherein the restriction in flow is greater in one direction than the other.

12. A method for operating a safety valve, the method comprises:

providing the safety valve to a wellbore having a hydrostatic pressure;

applying pressure to the safety valve with a single control line; wherein the safety valve comprises an accumulator in fluidic communication with the control line such that pressure acting on the accumulator is fluidically connected to pressure in the control line; wherein the safety valve is insensitive to the hydrostatic pressure; wherein the safety valve comprises:

an operating piston configured to translate axially along the length of the safety valve;

a balance piston configured to translate axially along the length of the safety valve; wherein the balance piston is coupled to the operating piston such that the operating piston and the balance piston translate axially at the same time;

a control line descending from an uphole surface; wherein the control line forms three flow paths; wherein the first flow path of the control line is coupled to a check valve; wherein the second flow path of the control is coupled to a poppet valve; wherein the third flow path is coupled to a flow restrictor;

a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston;

a balance pressure line comprising four segments; wherein the first segment of the balance pressure line is coupled to the poppet valve; wherein the second segment of the balance pressure line is coupled to the flow restrictor; wherein the third segment of the balance pressure line is coupled to the accumulator; wherein the fourth segment of the balance pressure line is coupled to the balance piston;

the check valve;

the poppet valve coupled; and the flow restrictor; and wherein the method further comprises applying pressure to the poppet valve from the second flow path of the control line to crack the poppet valve;

building pressure in the pressure lock flow path to translate the operating piston upon cracking the poppet valve; wherein translation of the operating piston also translates the coupled balanced piston; and building pressure in the balance pressure line from the third flow path of the control line to close the poppet valve; wherein closing the poppet valve locks in the pressure in the pressure lock flow path to maintain the balance piston in a translated position.

13. The method of claim 12, further comprising reducing pressure to the control line;

wherein reducing pressure to the control line releases a locked pressure in the safety valve.

14. The method of claim 13, further comprising releasing pressure stored in the accumulator when the pressure in the control line is reduced.

15. A system for operating a safety valve, the system comprising:

a safety valve comprising:

an operating piston configured to translate axially along the length of the safety valve;

a balance piston configured to translate axially along the length of the safety valve; wherein the balance piston in coupled to the operating piston such that the operating piston and the balance piston translate axially at the same direction and time;

a control line descending from an uphole surface; wherein the control line forms three flow paths; wherein the first flow path of the control line is coupled to a check valve; wherein the second flow path of the control line is coupled to a poppet valve; wherein the third flow path is coupled to a flow restrictor;

a pressure lock flow path comprising three segments; wherein the first segment of the pressure lock flow path is coupled to the check valve; wherein the second segment of the pressure lock flow path is coupled to the poppet valve; wherein the third segment of the pressure lock flow path is coupled to the operating piston;

a balance pressure line comprising four segments; wherein the first segment of the balance pressure line is coupled to the poppet valve; wherein the second segment of the balance pressure line is coupled to the flow restrictor; wherein the third segment of the balance pressure line is coupled to an accumulator; wherein the fourth segment of the balance pressure line is coupled to the balance piston;

the check valve;

the poppet valve;

the flow restrictor; and the accumulator;

a spring coupled to the operating piston of the safety valve; and a sliding sleeve coupled to the spring.

16. The system of claim 15, wherein the control line is a single control line and wherein there are no other control lines coupled to the safety valve.

17. The system of claim 15, wherein the safety valve is a wireline retrievable safety valve.

18. The system of claim 15, wherein the flow restrictor is configured to restrict flow bidirectionally between the third flow path of the control line and the second segment of the balance pressure line; wherein the restriction in flow is greater in one direction than the other.

19. The system of claim 15, wherein the sliding sleeve is coupled to a flapper and the sliding sleeve is configured to open or close the flapper upon the sliding of the sleeve.

20. The system of claim 15, wherein the poppet valve is configured to crack at a lower pressure than the check valve.

* * * * *